US005647832A

United States Patent [19]

Nickell et al.

[11] Patent Number: 5,647,832

[45] Date of Patent: Jul. 15, 1997

[54] APPARATUS FOR MANUFACTURING BAFFLE LINERS

[75] Inventors: Craig Alan Nickell; Vincent Edwin Durden, both of Sherman; Norman C. Derby, Bonham, all of Tex.

[73] Assignee: Super Sack Mfg. Corp., Dallas, Tex.

[21] Appl. No.: 383,887

[22] Filed: Feb. 6, 1995

Related U.S. Application Data

[62] Division of Ser. No. 37,072, Mar. 26, 1993, abandoned.

[51] Int. Cl.[6] ..... B31B 39/00

[52] U.S. Cl. ..... 493/217; 493/223; 493/243; 493/922

[58] Field of Search ..... 493/84, 87, 89, 493/90, 92, 93, 94, 95, 96, 97, 99, 100, 104, 125, 27, 129, 133, 151, 189, 193, 196, 199, 210, 217, 218, 219, 221, 227, 231, 235, 243, 254, 345, 346, 356, 379, 380, 381, 393, 394, 907, 922, 417, 223

[56] References Cited

U.S. PATENT DOCUMENTS

| | | | |
|---|---|---|---|
| 2,009,511 | 7/1935 | Nydegger . | |
| 3,266,710 | 8/1966 | Reeves | 493/922 |
| 3,430,815 | 3/1969 | Weimer et al. . | |
| 3,485,281 | 12/1969 | Wicks . | |
| 3,620,774 | 11/1971 | Ford . | |
| 3,637,458 | 1/1972 | Parrish . | |
| 3,754,063 | 8/1973 | Schirmer . | |
| 3,789,897 | 2/1974 | Saito . | |
| 3,822,037 | 7/1974 | Long . | |
| 3,929,275 | 12/1975 | Bolling et al. | 493/217 |
| 3,943,833 | 3/1976 | Brockmuller | 493/217 |
| 3,949,901 | 4/1976 | Tokita . | |
| 3,961,655 | 6/1976 | Nattrass et al. . | |
| 4,551,125 | 11/1985 | Pezzanna | 493/217 |
| 4,877,205 | 10/1989 | Rand . | |
| 4,903,859 | 2/1990 | Derby et al. | 383/119 |
| 4,946,291 | 8/1990 | Schnaars | 383/113 |
| 4,993,551 | 2/1991 | Lindsay | 383/38 |
| 5,046,860 | 9/1991 | Brennan | 383/38 |
| 5,076,710 | 12/1991 | Derby | 383/22 |
| 5,174,447 | 12/1992 | Fleming | 383/38 |
| 5,222,812 | 6/1993 | Cuddy et al. | 383/24 |
| 5,230,688 | 7/1993 | Hatchell | 493/193 |
| 5,230,689 | 7/1993 | Derby | 493/210 |
| 5,273,514 | 12/1993 | Fristensen | 493/210 |
| 5,282,544 | 2/1994 | Boots | 220/403 |
| 5,289,937 | 3/1994 | Boots | 383/119 |
| 5,301,490 | 4/1994 | Storandt | 493/210 |
| 5,328,267 | 7/1994 | Cuddy et al. | 383/105 |
| 5,421,804 | 6/1995 | LaFleur | 493/210 |
| 5,468,528 | 11/1995 | Schnaars et al. | 383/119 |

*Primary Examiner*—Joseph J. Hail, III
*Assistant Examiner*—Christopher W. Day
*Attorney, Agent, or Firm*—Michael A. O'Neil; Russell N. Rippamonti

[57] ABSTRACT

An apparatus for manufacturing a liner having baffles therein for use inside of a flexible bulk container, having a frame supporting a first feed means mounted adjacent to a feed path for feeding a sheet of liner material over the feed path at a first speed. A second feed means is mounted adjacent the feed path between the first feed means and a finishing end of the feed path for feeding a length of ribbon material over the feed path adjacent the sheet of liner material at a second speed. An attachment means is mounted adjacent the feed path for attaching the fed ribbon material to the fed sheet of liner material at spaced apart intervals. A cutter is mounted adjacent the feed path and between the attachment means and the finishing end for cutting a predetermined length of liner material having first and second ends. A folder folds the cut length of liner material in half along a fold line perpendicular to the longitudinal axis of an attached length of ribbon, such that the ribbon is inside of the fold. A heat sealer seams the first and second ends of the cut length of folded liner material to form a tubular liner with the attached ribbon forming baffles defining four substantially triangular shaped corner pockets in the liner.

4 Claims, 4 Drawing Sheets

APPARATUS FOR MANUFACTURING BAFFLE LINERS

This is a divisional application of Ser. No. 08/037,072 filed Mar. 26, 1993, now abandoned.

TECHNICAL FIELD

This invention relates generally to liners for use in flexible bulk containers for receiving, transporting, and storing flowable materials, and more particularly, to liners and a method and apparatus for manufacturing liners having baffles formed in the corners thereof for defining the shape of the containers when filled.

BACKGROUND OF THE INVENTION

Historically, flexible bulk containers have been used for receiving, storing, transporting and discharging flowable materials of all types. The containers are typically constructed from a woven fabric in a square or vertically rectangular shape with lift straps attached to each of the uppermost corners of the square or rectangle. Flexible liners are inserted into the containers to prevent leakage from the containers of flowable materials having very fine particles, to prevent the interior surface of the containers from contacting the flowable materials to allow reuse of the containers with a variety of flowable materials without contamination from a prior use, to prevent contamination of the flowable materials by elements external to the container, and to prolong the life of the containers.

Although square in shape when empty, upon filling, the flexible containers assume a more rounded shape. In many instances the filled containers are stored and transported about on square wooden pallets. The round shape results in wasted storage space and, in some instances, possible damage to portions of the filled containers which extend beyond the support surfaces of the square pallets.

In an attempt to overcome the foregoing problems, bridge panels have historically been attached to the interior of the containers to achieve a less rounded configuration when the containers are filled. The bridge panels are typically the same height but smaller in width than the side panels forming the perimeter wall of a container. Opposed edges of the bridge panel are attached vertically to adjacent side panels of the container with the corner seam connecting the adjacent side panels located between the vertical attachment points of the bridge panel, to thereby define a triangular shaped area between the bridge panel and the corner seam connecting the adjacent side panels to which the bridge panel is attached.

Such configuration has historically caused construction problems requiring the handling of multiple panels while attaching the interior bridge panels, and the flowable materials often leak through the stitch holes where the bridge panels are attached to the side panels. To allow the material to flow into the triangular shaped corners of the container, holes have to be cut in the panels, resulting in wasted fabric. Furthermore, liners can not be used in bridge panel containers.

SUMMARY OF THE INVENTION

The present invention overcomes the foregoing and other problems heretofore experienced in construction and use of flexible bulk containers by providing a liner having baffles therein to allow a filled container to retain its shape while realizing all the advantages of using a liner. In the baffle liner of the present invention, spaced apart rows of continuous strips are attached around the interior circumference of the liner at spaced apart intervals such that the length of liner material between adjacent heat seals alternates between equal in length to the length of strip material between the same adjacent seals to greater in length than the length of strip material. The areas wherein the length of liner material is greater than that of the strip material form the corners of the liner, with the shorter length of strip material functioning as a baffle, much the same as the bridge panels do in the containers.

When the liner is placed into a container and filled, flowable material flows through the space between the spaced apart strips and the into the corners. The strips retain the square shape of the container, and the absence of bridge panel seams reduces material leakage.

BRIEF DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
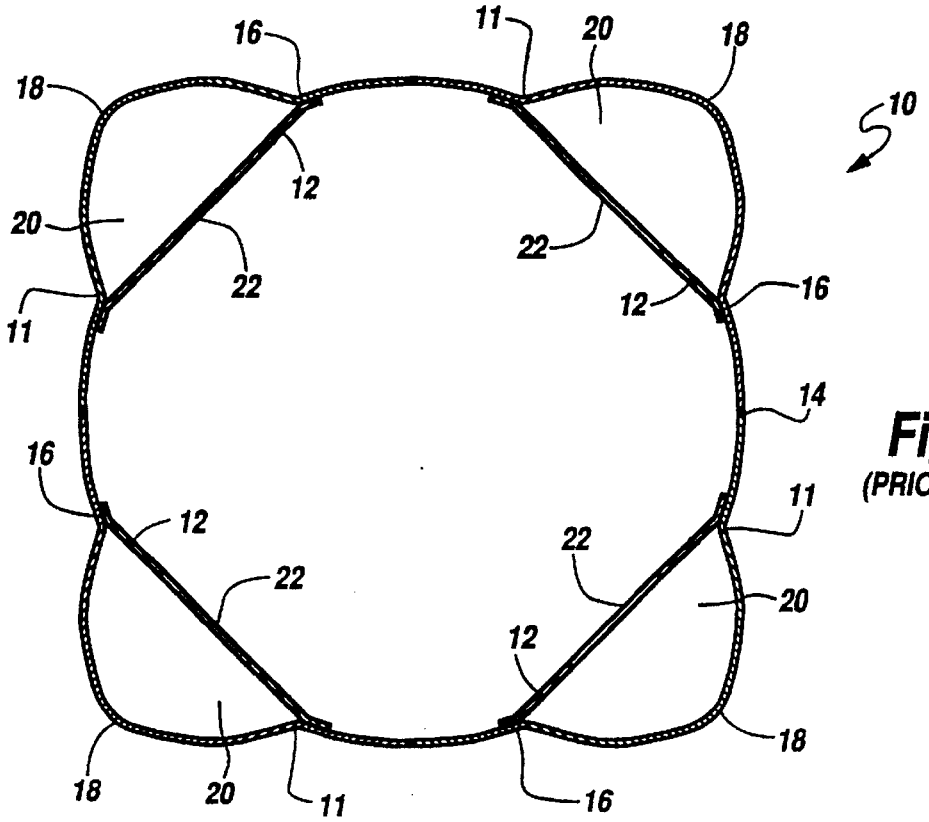
Fig.1 (PRIOR ART)
FIG. 1 is a top cross-section view of a prior art bridge panel container.

Referring now to the Drawings and more particularly to FIGS. 1 thereof, prior art bridge panel containers 10 were designed to retain the generally square shape of the container 10 when filled with flowable materials. Bridge panels 12 are seamed to the sidewalls 14 of the container 10, at seam lines 16 at spaced apart intervals adjacent to the corner seams 18 of the container 10. The bridge panel 12 creates a triangular shaped pocket 20 in the corner of the container 10. To allow flowable materials to pass into the pocket 20, portions of the bridge panel 12 are removed to form openings or holes 22 in the panels 12 to allow flowable materials to pass therethrough.

Flowable materials placed into the prior art container 10 often leak through the seam lines 16. The configuration of the prior art bridge container 10 prevents the use of a liner therein to avoid contamination of the flowable material by materials exterior to the container 10, as well as any flowable material previous placed into the container 10.

Figure 2:
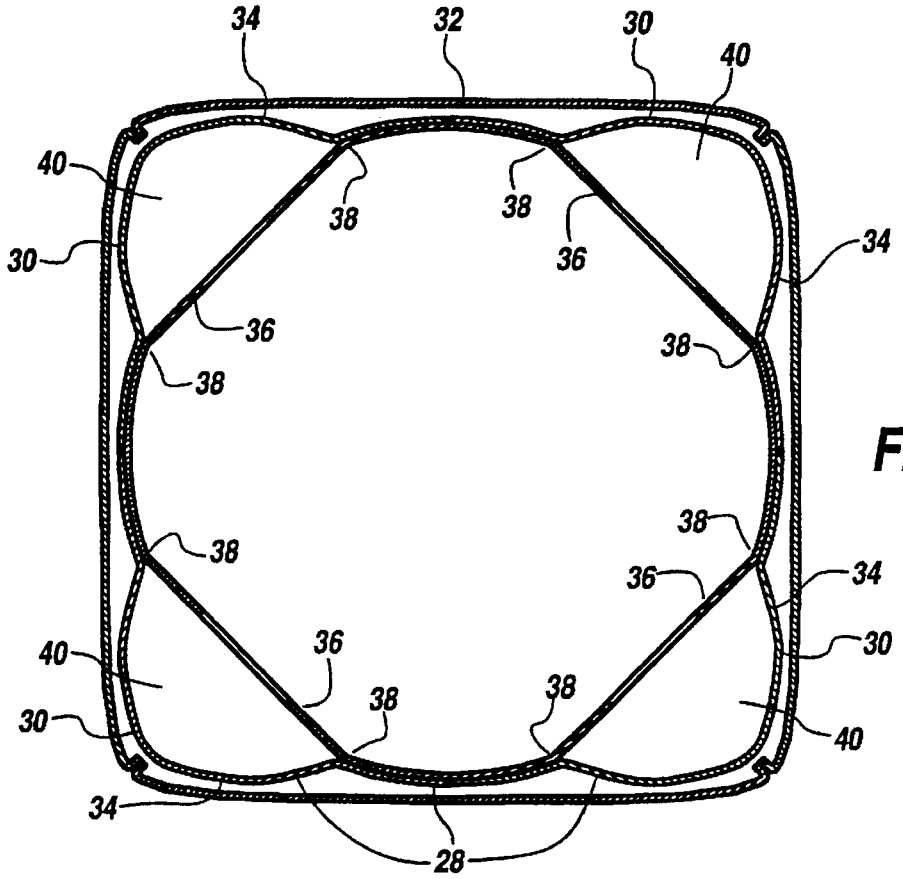
FIG. 2 is a top cross-section view of a container and liner incorporating a first embodiment of the baffle liner of the present invention inserted therein.
Figure 4:
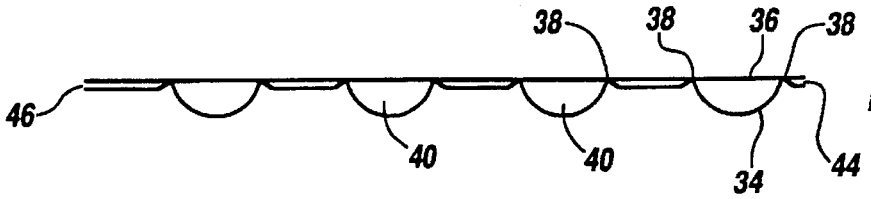
FIG. 4 is a cross-section view of the sheet of liner material of FIG. 3.
Figure 3:
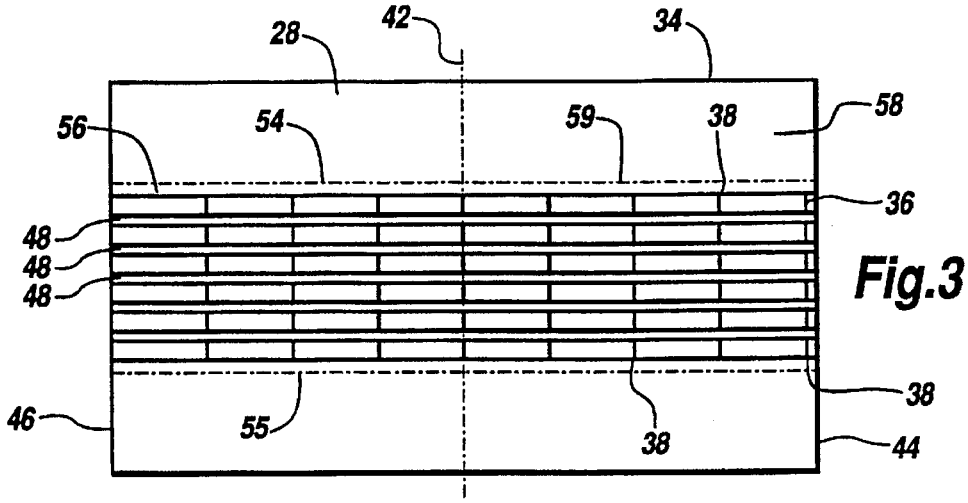
FIG. 3 is a flat sheet of liner material with spaced apart strips attached thereto prior to forming it into the liner of FIG. 2.
Figure 5:
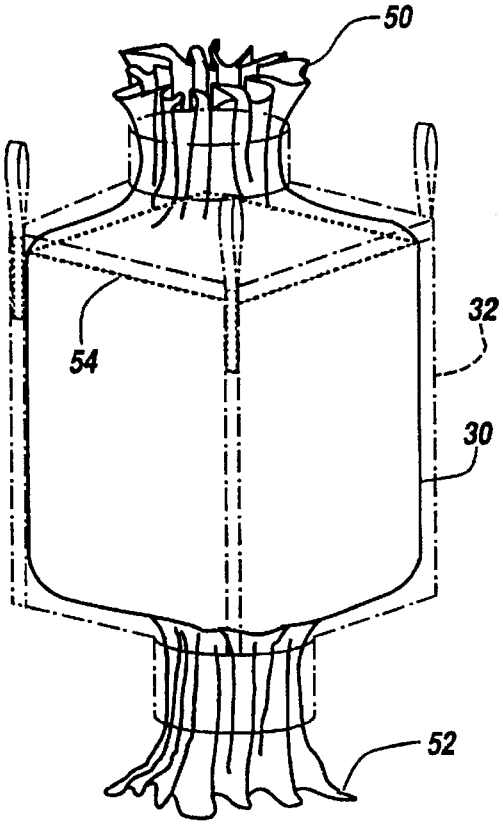
FIG. 5 is a front view of the liner of FIG. 2 inserted within a container, shown in phantom.

Referring now to FIG. 2, the liner 30 incorporating a first embodiment baffle liner of the present invention achieves the desired result of retaining the substantially square shape of a container 32 when filled with flowable material, while alleviating the problems associated with prior art bridge panel containers 10. As shown in FIGS. 2, 4, and 3, the body 28 of the baffle liner 30 is formed from a sheet of liner material 34 folded in half and seamed to form a tubular shaped baffle liner 30 as shown in FIG. 5.

As shown in FIGS. 3 and 4, the sheet of liner material 34 is equal in length to the circumference of the container 32 to be lined. Although the liner may be made from any of a number of commercially available materials, in the preferred embodiment of the invention the liner material is a thermoplastic film material, such as polyethylene or polypropylene, capable of being heat sealed.

Spaced apart baffle ribbons or strips 36 are attached to the sheet of liner material 34 at spaced apart intervals along the length of the sheet of liner material 34. As with the liner material 34, although the baffle strips 36 may be made from any of a number of commercially available materials, in the preferred embodiment of the invention the baffle material is a thermoplastic film, such as polyethylene or polypropylene, four to eight inches in width. The baffle strips 36 are preferably attached to the liner material 34 at the spaced apart intervals, of at least two inches, with heat seals 38.

The length of a sheet of liner material 34 between each adjacent heat seal 38 alternates from equal in length to the length of the baffle strips 36, to greater in length than the length of baffle strips 36, and back to equal in length to the length of baffle strips 36, thereby forming pockets 40 in the areas wherein the length of liner material 34 between adjacent heat seals 38 is longer than the length of the baffle strips 36. When the sheet of liner material 34 is folded in half along a center line indicated by dash line 42, opposed ends 44 and 46 are brought into alignment with one another. The ends 44 and 46 are then heat sealed, with the baffle strips 36 on the inside, to form the liner 30 with pockets 40 forming triangular shaped corners similar to those formed by the bridge panels 12 in the container 10 of FIG. 1.

The liner 30 is then inserted into the container 32, and when filled, retains the generally square shape of the container 32. Referring again to FIG. 3, the spaces 48 between the baffle strips 36 allow the flowable material to pass into the pockets 40 of the liner 30.

Because the strips 36 are preferably heat sealed to the liner material 34, and not stitched, the flowable material is less likely to leak from the container 32. Furthermore, the liner 30 may be replaced in the container 32 with each subsequent use of the container 32 to prevent possible contamination by prior flowable materials contained therein. Similarly, the liner 30 protects the flowable materials therein from contamination by materials exterior to the container 32, but capable of permeating the material from which the container 32 is fabricated.

Referring now to FIGS. 3 and 5, in many cases, it is desirable to have the liner 30 formed from two plies of liner material. To alleviate bulkiness in the fill spout 50 and discharge spout 52, the second ply 56 of liner material 34 is only as wide as the top and bottom fill lines of the container 32 as shown at broken lines 54 and 55, respectively. The width of the first ply 58 of liner material 34 extends beyond the fill line 54 a distance equal to the radius of the liner 30 plus the desired length of the fill spout 50, beyond on fill line 54, and the length of the radius plus the desired length of the discharge spout 52 beyond fill line 55.

Where the second ply 56 of the liner material 34 is interposed between the first ply 58 of liner material 34 and the strips 36 of baffle material, a heat seal 59 must be placed in the first and second plies, 58 and 56, respectively, along the fill line 54 to prevent flowable material from passing between the first and second plies, 58 and 56, respectively. If the first ply 58 of the liner material 34 is interposed between the second ply 56 of liner material 34 and the strips 36 of baffle material, no heat seal is required along fill line 54.

Figure 6:
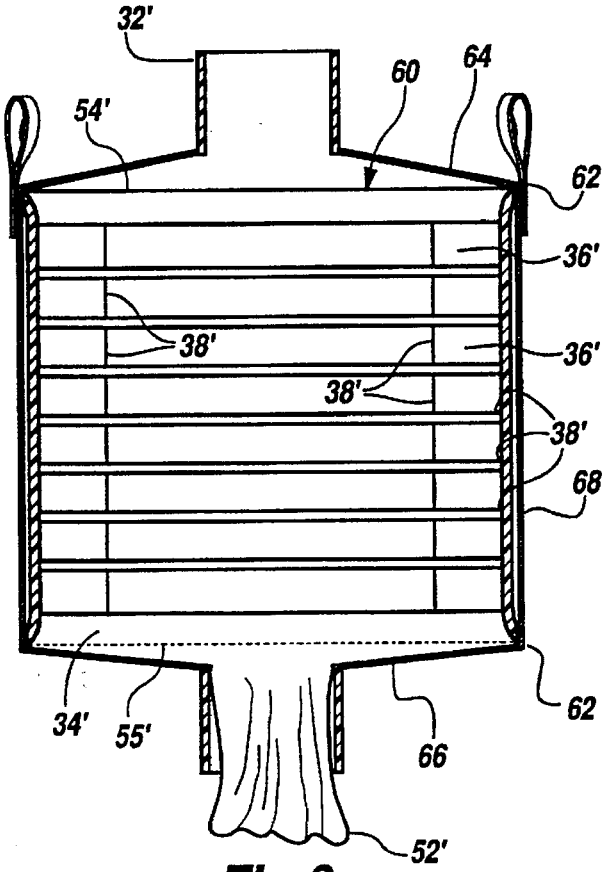
FIG. 6 is a cross-section view of a container having a liner incorporating second and third embodiments of the baffle liner of the present invention inserted therein.

Referring now to FIG. 6, there is shown a liner 60 incorporating a second embodiment of the baffle liner of the present invention. Many of the elements of the liner 60 are similar to those of the liner 30 of FIGS. 2–5 and will be given the same reference numerals with the elements of the liner 60 being differentiated by a prime "'" designation. The baffle liner 60 is formed from a sheet of liner material 34' having parallel strips 36' of baffle material attached thereto with heat seals 38'.

The liner 60 is formed from the sheet of liner material 34 in the same manner as liner 30, except that the sheet of liner material 34' extends only slightly beyond the fill line 54' a sufficient length to be stitched in the seam 62 connecting the top panel 64 of the container 32' to the side panels 68 of the container 32'. Thus, the liner 60 has no fill spout.

Referring still to FIG. 6, in a third embodiment of the liner of the present invention, the sheet of liner material 34' extends only slightly beyond the fill lines 54' and 55' a sufficient length to be stitched in the seams 62 connecting the top panel 64 and the bottom panel 66 of the container 32' to the side panels 68 of the container 32'. Thus, the liner 60 has no fill or discharge spout.

Figure 7:
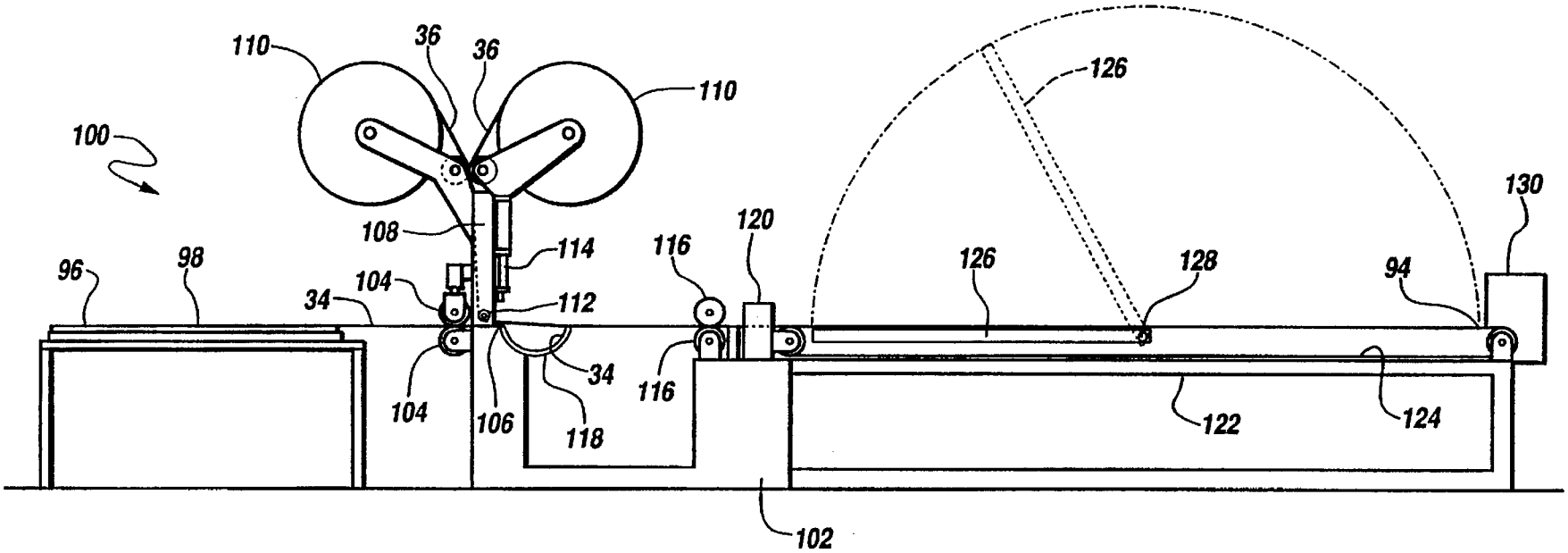
FIG. 7 is a side view of an apparatus for manufacturing the baffle liner of the present invention.
Figure 8:
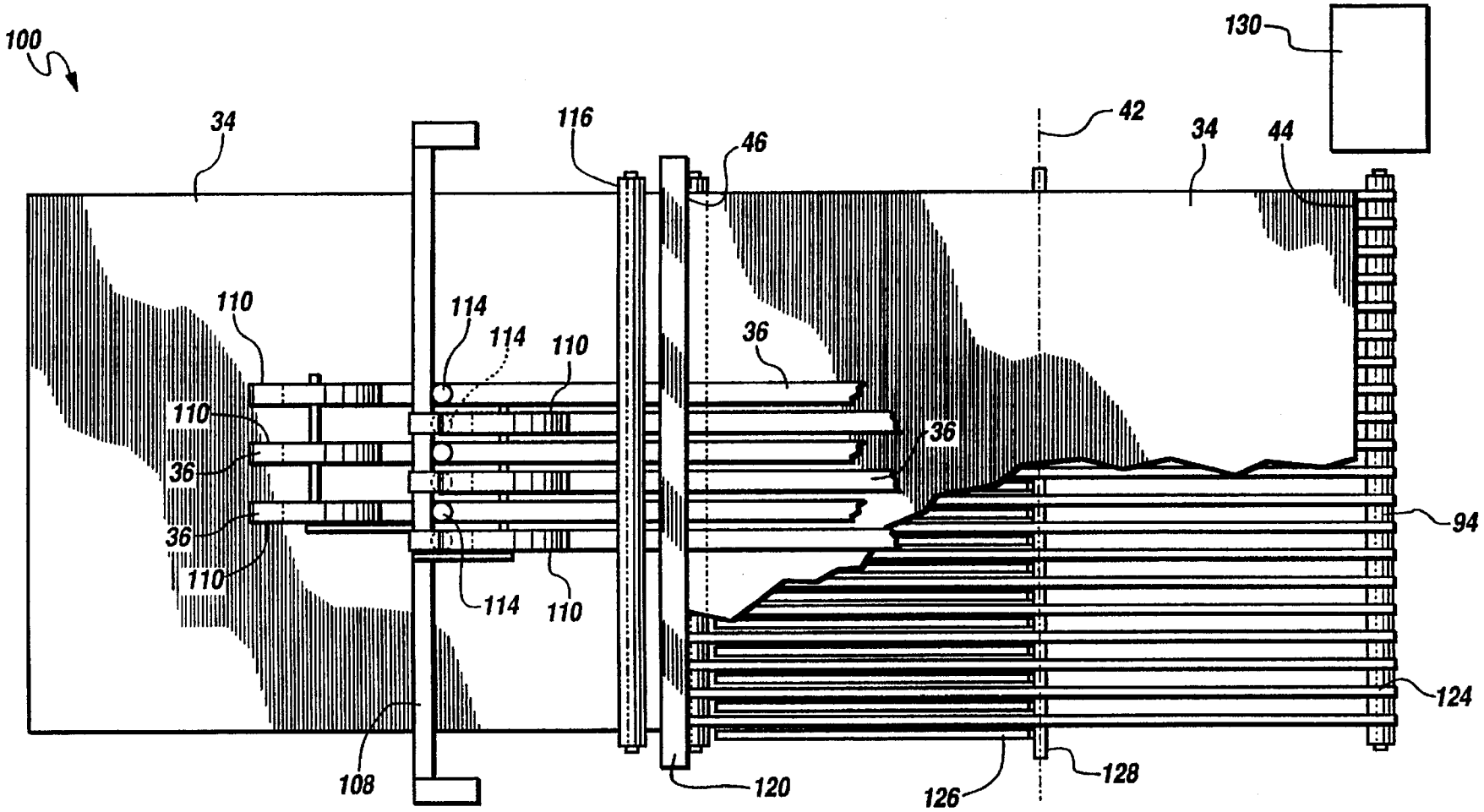
FIG. 8 is a top view of the apparatus of FIG. 7.

Referring now to FIGS. 7 and 8, there is shown an apparatus 100 for constructing the baffle liners 30 and 60 of the present invention. A frame 102 defines a feed path 98 having an input end 96 and a finishing end 94. Mounted on the frame 102 near the input end 96 of the feed path 98 are opposed feed rollers 104 for contacting and moving a sheet of liner material 34 as it enters the input end 96 of the feed path 98 and passes over a sealing surface 106. Mounted above feed rollers 104 and extending transversely across the feed path 98 and across the width of the liner material 34 is a spool frame 108 for supporting a plurality of spaced apart spools 110 of baffle strip material 36.

As the strip material 36 is unwound from the spools 110, it passes under guide rolls 112 positioned slightly above and adjacent the sealing surface 106. Mounted to the spool frame 108 and extending across the feed path 98 directly above the sealing surface 106 are a plurality of individual heat sealers 114 positioned above the path of travel of the strips 36 as they pass over the sealing surface 106. Thus, upon actuation of the heat sealers 114, the strips 36 are attached to the sheet of liner material 34.

The rate at which the strips 36 are unwound from the spools 110 is controlled by a pair of strip feed rolls 116 mounted on the frame 102. Interposed between the feed rolls 104 and 116 is a trough 118 for receiving lengths of the sheet of liner material 34 therein for forming the pockets 40 of the liner. To form the pockets, feed rolls 104 are variable speed rollers which move at a faster rate than rollers 116 to feed excess liner material 34 into the trough 118 when forming the pockets 40, and slowing the speed equal to that of rollers 116 to form the flat sections between the pockets 40 of the liner 30.

Mounted on the frame 102 at a position between the feed rolls 116 and the finishing end 94 is a cutter 120 followed by a half folder frame 120 having continuous conveyor belts 124 mounted for continuous rotation in a direction substantially perpendicular to the cutter 120. A fold arm 126 is pivotally mounted on the folder frame 122 for pivotal movement from a generally horizontal position adjacent the cutter 120 upwardly and away from the cutter 120 through an angle of 180°. Thus, as a predetermined length of liner material 34 and attached baffle strips 36 pass through the feed rollers 116, the cutter 120 is actuated to sever a predetermined length of liner material 34, following which the folder arm 126 is pivoted about a pivotal attachment point 128 to the folder frame 122 to raise the end 46 of the sheet of liner material 34 and fold it in half along center line 42, bringing ends 46 and 44 into contact with one another. A band heat sealer 130 heat seals ends 46 and 44 together to form the liner 30.

Although preferred embodiments of the present invention has been illustrated in the accompanying Drawings and described in the foregoing Detailed Description, it will be appreciated by those skilled in the art that various modifications and rearrangements of the component parts and elements of the present invention are possible within the scope of the present invention.

We claim:

1. An apparatus for manufacturing a liner having baffles therein for use in flexible bulk containers, comprising:

a feed path having an input and an finishing end;

first feed means mounted adjacent the feed path for feeding a sheet of liner material over the feed path at a first speed;

second feed means mounted adjacent the feed path between the first feed means and the finishing end for feeding a length of ribbon material over the feed path adjacent the sheet of liner material at a second speed;

attachment means mounted adjacent the feed path for attaching the fed ribbon material to the fed sheet of liner material at spaced apart intervals;

cutting means mounted adjacent the feed path and between the attachment means and the finishing end for cutting a predetermined length of liner material having first and second ends;

folding means for folding the cut length of liner material in half along a fold line perpendicular to a longitudinal axis of a attached length of ribbon such that the ribbon is inside of the fold; and seaming means for seaming the first and second ends of the cut length of folded liner material to form a tubular liner with the attached ribbon forming baffles defining substantially triangular shaped corners in the liner.

2. The apparatus of claim 1, further comprising means for varying the first speed of the first feed means relative the second speed of the second feed means to position adjacent the length of ribbon a length of liner material greater in length than the adjacent ribbon to form a pocket of excess liner material between adjacent attachment portions of the ribbon to the liner.

3. The apparatus of claim 1, further comprising support means mounted adjacent the feed path and between the first feed means and the second feed means for supporting spools of ribbon material.

4. The apparatus of claim 1, wherein the attachment means further comprised individual heat sealers mounted above the feed path for heat sealing the ribbon to the liner material.

* * * * *